US011260551B2

(12) United States Patent
Heidlmayer

(10) Patent No.: US 11,260,551 B2
(45) Date of Patent: Mar. 1, 2022

(54) ULTRASONIC CUTTER

(71) Applicant: GFM GmbH, Steyr (AT)

(72) Inventor: Franz Heidlmayer, St. Marien (AT)

(73) Assignee: GFM GmbH, Steyr (AT)

( * ) Notice: Subject to any disclaimer, the term of this patent is extended or adjusted under 35 U.S.C. 154(b) by 0 days.

(21) Appl. No.: 17/044,531

(22) PCT Filed: Sep. 30, 2019

(86) PCT No.: PCT/AT2019/060320
§ 371 (c)(1),
(2) Date: Oct. 1, 2020

(87) PCT Pub. No.: WO2020/069544
PCT Pub. Date: Apr. 9, 2020

(65) Prior Publication Data

US 2021/0146564 A1 May 20, 2021

(30) Foreign Application Priority Data

Oct. 1, 2018 (AT) ..... A 50840/2018

(51) Int. Cl.
*B26D 1/00* (2006.01)
*B26D 3/02* (2006.01)
*B26D 7/08* (2006.01)

(52) U.S. Cl.
CPC ..... *B26D 1/0006* (2013.01); *B26D 3/02* (2013.01); *B26D 7/086* (2013.01); *B26D 2001/006* (2013.01); *B26D 2001/0053* (2013.01)

(58) Field of Classification Search
CPC ..... B26D 1/0006; B26D 2001/0053; B26D 2002/006; B26D 3/02; B26D 3/282; B26D 7/086
See application file for complete search history.

(56) References Cited

U.S. PATENT DOCUMENTS 6,575,064 B2 * 6/2003 Hart ..... B26D 3/02 83/16
7,614,937 B2 * 11/2009 Nydegger ..... B26D 1/0006 30/346.55

(Continued)

FOREIGN PATENT DOCUMENTS

DE 35 30 886 A1 11/1986
DE 198 55 803 A1 6/2000
EP 0 540 496 A1 5/1993

(Continued)

*Primary Examiner* — Stephen Choi
(74) *Attorney, Agent, or Firm* — Muirhead and Saturnelli, LLC

(57) ABSTRACT

An ultrasonic cutter cuts edge chamfers of plate-shaped workpieces using a cutter head which forms an axis of rotation and a blade which extends from the cutter head and forms a cutting wedge, terminating in a straight cutting edge, between flank and contact faces determined by the wedge angle. In order to create advantageous structural conditions, the axis of rotation extending on the blade side of the flank face is at a distance from the flank face which is equal to or greater than the distance of the center of mass of the blade from the flank face and the cutting edge, extending in the direction of the axis of rotation, extends at a distance from the axis of rotation which corresponds at most to the blade thickness.

12 Claims, 3 Drawing Sheets

(56) References Cited

U.S. PATENT DOCUMENTS

| | | | | |
|---|---|---|---|---|
| 2008/0083308 | A1 | 4/2008 | Evans et al. | |
| 2014/0360325 | A1* | 12/2014 | Heidlmayer | B29C 70/545 83/39 |

FOREIGN PATENT DOCUMENTS

| | | | |
|---|---|---|---|
| EP | 0 754 992 | A1 | 1/1997 |
| EP | 2 055 451 | A1 | 5/2009 |
| EP | 2 810 752 | A1 | 12/2014 |
| EP | 2 894 014 | A1 | 7/2015 |
| EP | 3 078 432 | A1 | 10/2016 |

* cited by examiner

ULTRASONIC CUTTER

TECHNICAL FIELD

The system described herein relates to an ultrasonic cutter for the cutting of edge chamfers of plate-shaped workpieces with a cutter head which forms an axis of rotation and with a blade which extends from the cutter head and forms a cutting wedge, terminating in a straight cutting edge, between flank and contact faces determined by the wedge angle.

BACKGROUND OF THE INVENTION

Conventional ultrasonic cutters, i.e. cutters that are excited to oscillate with the aid of ultrasound, have a cutter head that can be inserted into a cutter holder and are moved by a feed device along a predetermined contour shape tangentially to the contour line to trim a plate-shaped workpiece (US 2008/0083308 A1). The cutter head thereby forms an axis of rotation which, together with the feed direction, determines a cutting plane in which the cutting edges of the blade emanating from the cutter head are disposed. The blade is symmetrically formed both in relation to the cutting plane and in relation to a plane perpendicular to it by the axis of rotation, which not only leads to the formation of cutting edges inclined to each other on both sides, but also ensures that the cutting edge progression is not affected by transverse vibrations. However, these known ultrasonic cutters are only conditionally suitable for cutting edge chamfers of plate-shaped workpieces, because the chamfer faces, even with a non-straight edge progression, are to be determined by straight generatrices (point, curve or surface that, when moved along a given path, generates a new shape), which lie in a plane perpendicular to the edge progression at a constant angle of inclination, and the cutting edges, which are inclined with respect to the axis of rotation, extend outside these planes of the generatrices, which becomes increasingly important with increasing thickness of the plate-shaped workpieces and decreasing radius of curvature of the edge progression.

In addition, the cutting wedge, which ends in the cutting edge and is determined by a flank face and a contact face, also forms with the flank face a displacement surface inclined at half the wedge angle, along which the material is displaced from the cutting plane towards the workpiece, so that in the case of materials sensitive to this, such as materials with a honeycomb structure or a fibrous web, disturbances occur in the cut surface of these workpieces. Separate cutters are therefore used for chamfer cutting, which have a single-edged blade with two cutting edges inclined to each other and ending in a point with the disadvantage that the cutting edges are not in the direction of the generatrices of the edge chamfers to be cut.

In addition, it is known (DE 35 30 886 A1) to move the cutting edge of an ultrasonic cutter into the axis of rotation of the cutter head. Due to this circumstance, the blade can easily be guided in such a way that the cutting edge coincides with the generatrices of the nominal cutting face. If the cutting wedge is formed by two chamfers, the flank face represents a displacement surface acting on the cutting face. In the case of a cutting wedge with only one chamfer, the flank face is located in the cutting plane, but due to the resulting displacement of the center of gravity of the blade, vibrations occur transversely to the cutting plane, which impair the cutting accuracy and represent a considerable additional load for the blade, in particular with longer blades, as required for cutting edge chamfers of plate-shaped workpieces.

Thus, it is desirable to provide an ultrasonic cutter for the cutting of edge chamfers of plate-shaped workpieces in such a way that longer cutting edges can be used for chamfer cutting even thicker workpieces with a curved edge progression without having to fear any loss of cutting accuracy or overloading of the blade.

SUMMARY OF THE INVENTION

Based on an ultrasonic cutter of the type described above, the system described herein provides an axis of rotation that extends on the blade side of the flank face is at a distance from the flank face which is equal to or greater than the distance of the center of mass of the blade from the flank face, where the cutting edge extends in the direction of the axis of rotation and extends at a distance from the axis of rotation which corresponds at most to the blade thickness.

The progression of the flank face of the cutting wedge results in a blade that is asymmetrical in relation to the cutting plane and thus brings with it the danger that the blade is excited to transverse vibrations. This danger may be counteracted by ensuring that the feed of the cutter head is at least approximately in the direction of a straight line perpendicular to the axis of rotation and passing through the center of gravity of the blade. For the design of the blade, this means that the distance of the center of mass of the blade from the flank face is a distance equal to or less than the distance of the axis of rotation from the flank face, so that the flank face does not become a displacement surface protruding above the cutting plane. The axis of rotation extends on the blade side of the flank face, i.e. on the side, which faces away from the workpiece, of the flank face which faces the workpiece.

The displacement of the cutting plane towards the workpiece in relation to the axis of rotation which is linked to the eccentric progression of the flank face in relation to the axis of rotation may be easily taken into account by controlling the cutter head movement. However, the distance of the cutting edge from the axis of rotation may be limited to ensure simple cutter head control. A distance between the axis of rotation and the cutting edge of no more than the blade thickness is sufficient to meet this requirement, taking into account any displacement of the cutting edge caused by regrinding.

Since the cutting edge extends in the direction of the axis of rotation of the cutter head and the cutter head may be guided transversely to the feed direction with an orientation of the axis of rotation, the cutting edge is oriented in the area of a curvature of the edge progression in the direction of the generatrices of the conical surface determining the chamfer face, which is an essential prerequisite for precise machining of the chamfer faces of plate-shaped workpieces in the area of curved edge progressions, with a comparatively low control expenditure for the cutter head.

In order to ensure advantageous conditions with regard to mass distribution, the width of the blade may decrease towards the blade tip, which leads to a blade back tapered towards the blade tip while maintaining a constant wedge angle of the blade.

The requirement that the cutting edge should extend in the direction of the axis of rotation does not necessarily mean that the cutting edge is oriented exactly parallel to the axis of rotation. An inclination of the cutting edge with respect to the axis of rotation by a maximum of 5° around an axis perpendicular to a plane passing through the axis of rotation and the center of mass of the blade is perfectly permissible in view of the required accuracy of the machining of the chamfer faces and may bring advantages with respect to the cutting forces.

BRIEF DESCRIPTION OF THE DRAWINGS

The subject matter of the invention is shown in the drawings by way of example, wherein.

DESCRIPTION OF VARIOUS EMBODIMENTS

Figure 1:
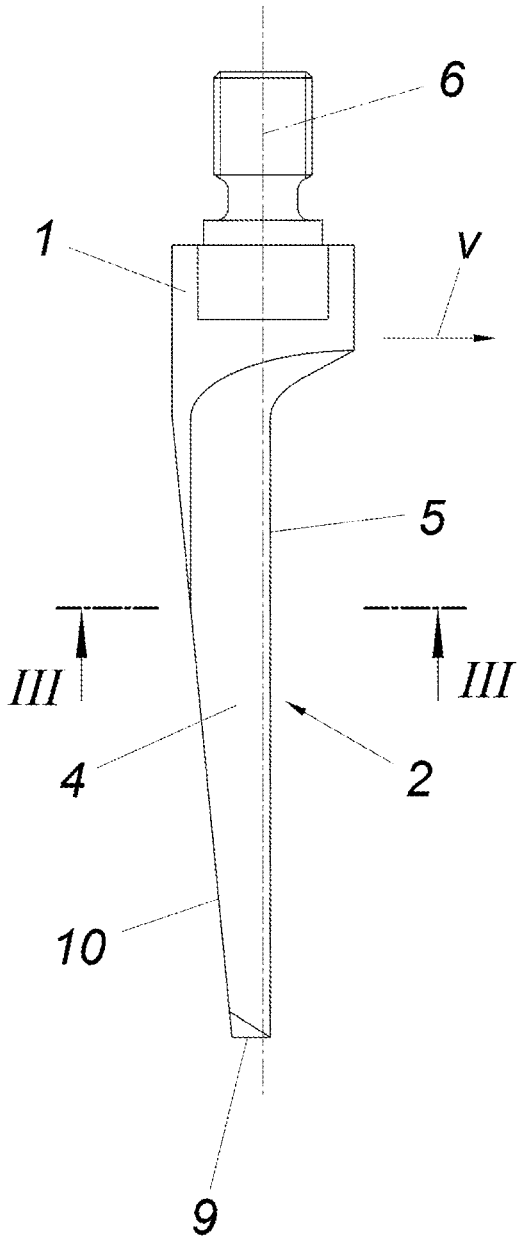
FIG. 1 shows a side view of an ultrasonic cutter according to the system described herein.

An ultrasonic cutter according to the system described herein has a cutter head 1 with a blade 2 adjoining the cutter head 1, which blade 2 forms a cutting wedge between a flank face 3 and a contact face 4. The flank face 3 and the contact face 4 end in a straight cutting edge 5. The cutter head 1, which is inserted in a cutter holder, may be rotated through the cutter holder and forms an axis of rotation 6 for the blade 2.

Figure 2:
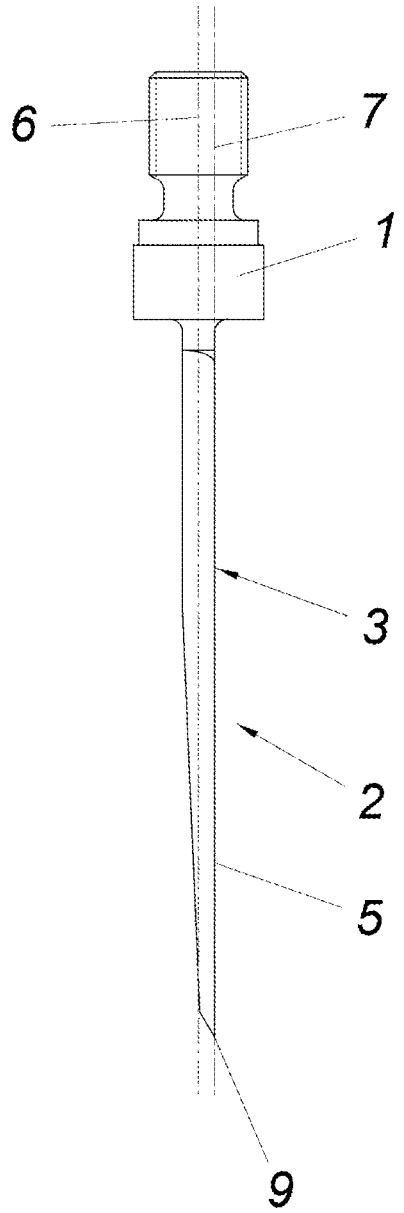
FIG. 2 shows a front view of an ultrasonic cutter according to the system described herein.
Figure 4:
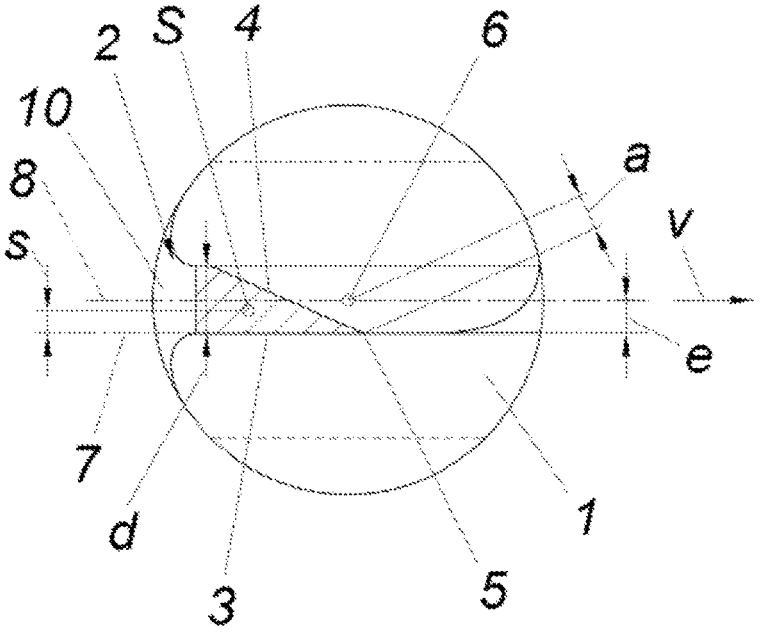
FIG. 4 shows a section according to lines III-III of FIG. 1 on a larger scale of an ultrasonic cutter according to the system described herein.

As can be seen in particular in FIGS. 2 and 4, the cutting edge 5 and the axis of rotation 6 extend parallel to each other at a distance a. Furthermore, the flank face 3 extends eccentrically in relation to the axis of rotation 6 at a distance e. The cutting face 7 resulting from a feed direction v, which may include a clearance angle ≥0° with the flank face, thus also extends at a distance from the axis of rotation 6. If a feed direction v is selected for the ultrasonic cutter that extends parallel to the flank face 3, i.e. the clearance angle between the flank face 3 and the cutting plane is 0°, the center of mass S of the blade 2 will come to lie in the area of a guide plane 8 for the ultrasonic cutter determined by the feed direction v and the axis of rotation 6 under the precondition that the distance e between the axis of rotation 6 and the flank face 3 is greater than the distance s of the center of mass S from the flank face 3, so that disturbing transverse oscillations of the blade 2 may be largely eliminated. If no other disturbance variables have to be taken into account, particularly advantageous machining conditions result if the guide plane 8 coincides with a plane which is defined by the axis of rotation 6 and a straight line perpendicular to the axis of rotation 6 and passing through the center of mass S, i.e. contains the center of mass S.

The distance a between the cutting edge 5 and the axis of rotation 6 should take into account the position of the center of mass S in relation to the cutting plane 7 or the flank face 3 without jeopardizing the simple movement control of the cutter head 1. For this reason, the distance a between the cutting edge 5 and the axis of rotation 6 is to be limited and may not exceed the blade thickness d. With such a maximum distance a, later displacements of the cutting edge 5 may also be taken into account by regrinding the blade 2.

Figure 3:
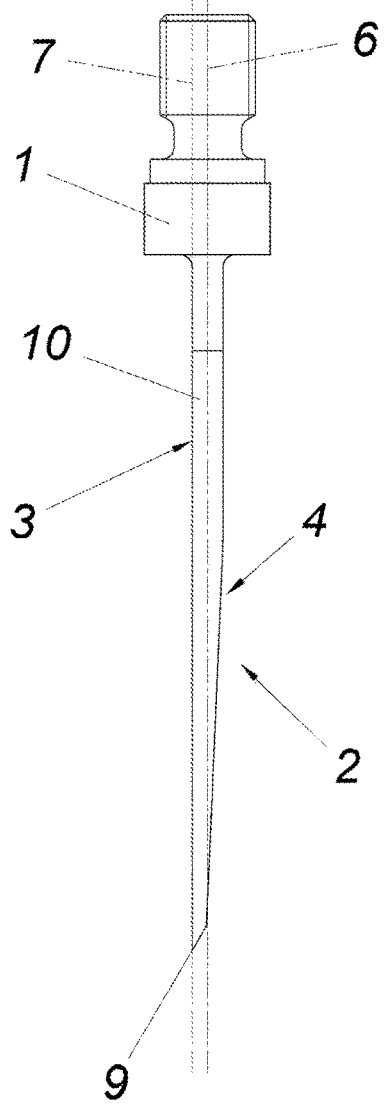
FIG. 3 shows a rear view of an ultrasonic cutter according to the system described herein.

In order to achieve an advantageous mass distribution in the blade area, the width of the blade 2 may decrease towards the blade tip 9. At a constant wedge angle of the cutting wedge of the blade 2, this means that the blade back 10 tapers towards the blade tip 9, as shown in FIG. 3.

Since the flank face 3 lies in the cutting plane 7 with the use of an ultrasonic cutter according to the system described herein and according to FIGS. 1 to 4 and, at a straight cutting path, does not form a displacement surface, along which material areas are pressed out of the cut surface against the workpiece, no defects otherwise attributable to this circumstance may occur in the area of the cut surface either, so that in conjunction with the cutting edge progression which is aligned in a special way with respect to the axis of rotation 6, an accurate, largely error-free cutting of edge chamfers of plate-shaped workpieces is possible, even if these workpieces have a honeycomb structure or a fibrous web with and without cover layers.

During chamfer cutting in the area of concave edge progressions, a flank face 3 lying in the cutting plane 7 presses on the conical cut surface, but the resulting load on the cut surface remains in the elastic area of the material due to the comparatively small blade width, in particular if this material has a honeycomb structure or a fibrous web. If these elastic deformations of the material to be cut are also to be avoided, the blade 2 of the ultrasonic cutter may be guided in such a way that a corresponding clearance angle is maintained between the flank face 3 and the cutting plane 7, as shown in FIG. 5.

Figure 5:
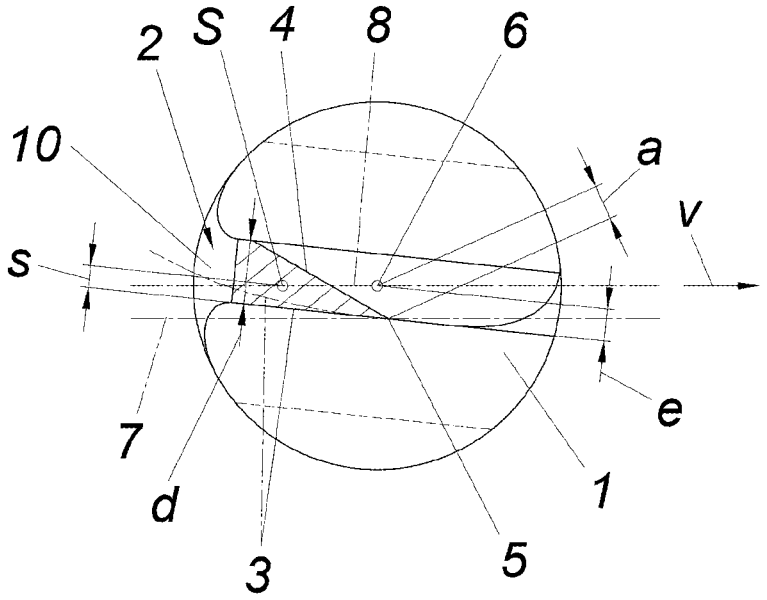
FIG. 5 shows an embodiment of a variant of an ultrasonic cutter according to the system described herein.

FIG. 5 shows the position of blade 2 for a knife guide in which, in order to suppress transverse oscillations, the center of mass S of blade 2 lies in the guide plane 8 determined by the axis of rotation 6 and the feed direction v. In comparison with FIG. 4, however, the flank face 3 is inclined away from the cutting plane 7 parallel to the guide plane 8, which corresponds to a clearance angle >0, so that concave edge progressions of the workpiece with smaller radii of curvature may also be machined without having to accept material displacement by the flank face 3 outside the elastic area. The profile shape of the flank face 3 may be different and may also have a curvature, for example, as indicated by the dash-dotted lines in FIG. 5.

In the drawing, the progression of the cutting edge 5 is always shown parallel to the axis of rotation 6, but this is not mandatory if only the cutting edge 5 extends at least approximately in the direction of the axis of rotation 6. The inclination of the cutting edge 5 in relation to the axis of rotation 6, however, is limited in order to ensure that the chamfer faces in the area of curved edge progressions of the workpiece are largely adapted to conical surfaces during chamfer cutting. For this reason, the cutting edge 5 may enclose an angle of at most 5°, preferably 3°, with the axis of rotation 6 in a normal projection on guide plane 8.

As can be seen from the above explanations, the positional allocation of the axis of rotation 6 in relation to the cutting edge 5, the flank face 3 and the center of mass S of the blade 2 in accordance with the system described herein creates an ultrasonic cutter that may also meet high requirements with regard to stability and cutting accuracy, if the feed direction v is chosen such that the feed direction v passing through the axis of rotation 6 and perpendicular to the axis of rotation 6 defines a guide plane 8 for the ultrasonic cutter which contains the center of mass S of the blade 2 or at least passes close to this center of mass S.

The system described herein is not restricted to the described embodiments. It may be varied within the scope of the claims, taking into account the knowledge of the relevant person skilled in the art. Other embodiments of the system described herein will be apparent to those skilled in the art from a consideration of the specification and/or an attempt to put into practice the system described herein. It is intended that the specification and examples be considered as illustrative only, with the true scope and spirit of the invention being indicated by the following claims.

The invention claimed is:

1. Ultrasonic cutter that is excited to oscillate with the aid of ultrasound and used for the cutting of edge chamfers of plate-shaped workpieces, comprising:

a cutter head that is rotatable through a cutter holder for the cutter head to form an axis of rotation; and a blade, which extends from the cutter head and forms a cutting wedge ending in a straight cutting edge between a flank face and a contact face determined by a wedge angle, wherein the axis of rotation extends on a blade side of the flank face at a distance from the flank face which is equal to or greater than a shortest distance of the center of mass of the blade from the flank face, wherein the cutting edge extends in a direction of the axis of rotation at a distance from the axis of rotation which is no greater than the blade thickness, wherein a feed of the cutter head is in a direction that is perpendicular to the axis of rotation and parallel to a cutting plane of the workpieces, and wherein the flank face is substantially parallel to the cutting plane.

2. Ultrasonic cutter according to claim 1, wherein the width of the blade decreases towards a tip of the blade.

3. Ultrasonic cutter according to claim 2, wherein the cutting edge extends in an inclined manner by at most 5° relative to the cutting plane when rotated about an axis of rotation perpendicular to the flank face.

4. Ultrasonic cutter according to claim 2, wherein a back of the blade tapers towards the tip of the blade.

5. Ultrasonic cutter according to claim 1, wherein the cutting edge extends in an inclined manner by at most 5° relative to the cutting plane when rotated about an axis of rotation perpendicular to the flank face.

6. Ultrasonic cutter according to claim 1, wherein the cutting edge extends in a direction of the axis of rotation at a distance from the axis of rotation no greater than the blade thickness following displacement of the cutting edge caused by regrinding.

7. Ultrasonic cutter according to claim 1, wherein the cutting edge forms a generatrix of a conical surface determining a chamfer face of the workpieces.

8. Ultrasonic cutter according to claim 7, wherein the workpieces have a honeycomb structure or a fibrous web.

9. Ultrasonic cutter according to claim 7, wherein a clearance angle between the flank face and the cutting plane is 0°.

10. Ultrasonic cutter according to claim 9, wherein the flank face presses on the conical surface.

11. Ultrasonic cutter according to claim 10, wherein the workpiece has a honeycomb structure or a fibrous web.

12. Ultrasonic cutter according to claim 1, wherein the flank face is inclined away from the cutting plane.

* * * * *